US006039463A

United States Patent [19]

Lin

[11] Patent Number: 6,039,463

[45] Date of Patent: Mar. 21, 2000

[54] LAMP ASSEMBLY

[76] Inventor: Shih-Ming Lin, No. 132, Hsi Hsin Street, Chang Ya Tsun, Hsiu Shui Hsiang, Chang Hua Hsien, Taiwan

[21] Appl. No.: 09/149,087

[22] Filed: Sep. 8, 1998

[51] Int. Cl.[7] ..... F21S 1/12

[52] U.S. Cl. ..... 362/414; 362/410

[58] Field of Search ..... 362/410, 395, 362/437, 439, 443, 448, 353, 414, 433, 431

[56] References Cited

U.S. PATENT DOCUMENTS

| | | | |
|---|---|---|---|
| 4,998,193 | 3/1991 | Chuing-Hui | 362/414 |
| 5,826,975 | 10/1998 | Hsieh | 362/414 |
| 5,951,153 | 9/1999 | Favela | 362/414 |

*Primary Examiner*—Sandra O'Shea
*Assistant Examiner*—Hargobind S. Sawhney
*Attorney, Agent, or Firm*—Bacon & Thomas

[57] ABSTRACT

A lamp assembly including a light bulb, a lamp pole, a lampshade, a lamp cup, a butterfly-shaped nut, a light bulb holder, an end cover, a hollow bolt, and a securing nut. In assembly, an upper section of the hollow bolt is locked with a threaded hole from a lower side of the light bulb holder, with a lower section thereof entering a flared portion at an upper end of the lamp cup and then out through a through hole to lock with a central threaded hole of the end cover. The securing nut is then used to lock tightly with the remaining exposed portion of the hollow bolt. That is, an external threaded section on a lower side of the end cover engages lockably with internal threads on an upper side of the lamp pole. Finally, the light bulb holder enters from a through hole below the lampshade, using the butterfly-shaped nut to lock tightly external threads on an upper side of the light bulb holder, whereby the light bulb can lock directly deep into the light bulb locking seat located in the light bulb holder at the bottom side and be positioned. The lampshade assembly can be easily assembled by the user. After assembly, the light bulb does not project obtrusively from the lampshade so that the overall assembly looks graceful and is safe to use. Besides, the overall size of the lamp assembly during transportation can be reduced to save costs.

1 Claim, 2 Drawing Sheets

LAMP ASSEMBLY

BACKGROUND OF THE INVENTION (a) Field of the Invention

The present invention relates to a lamp assembly, and more particularly to the structure of assembly of a lampshade and a lamp cup.

(b) Description of the Prior Art

The conventional lampshade is largely integrally formed and is therefore large in size and occupies space in packaging and transportation.

In the prior art, the light bulb projects partly from an upper end of the lampshade. If the lamp is mounted near the ceiling board, the ceiling board may become overheated and burn. Besides, such a configuration does not appear graceful or elegant, and does not match modern interior design. It is therefore necessary to provide an improvement to obviate the disadvantages of the prior art and to meet the do-it-yourself trend.

SUMMARY OF THE INVENTION

A primary object of the present invention is to provide a lamp assembly that eliminates the problems of the prior art, meets the consumers' demand, and conforms to safety standards.

In order to achieve the above-mentioned object, the lampshade according to the present invention comprises a light bulb, a lamp pole, a lampshade, a lamp cup, a butterfly-shaped nut, a light bulb holder, an end cover, a hollow bolt, and a securing nut. In assembly, an upper section of the hollow bolt is locked with a threaded hole from a lower side of the light bulb holder, with a lower section thereof entering a flared portion at an upper end of the lamp cup and then out through a through hole to lock with a central threaded hole of the end cover. The securing nut is then used to lock tightly with the remaining exposed portion of the hollow bolt. That is, an external threaded section on a lower side of the end cover engages lockably with internal threads on an upper side of the lamp pole. Finally, the light bulb holder enters from a through hole below the lampshade, using the butterfly-shaped nut to lock tightly external threads on an upper side of the light bulb holder, whereby the light bulb can lock directly deep into the light bulb locking seat located in the light bulb holder at the bottom side and be positioned.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
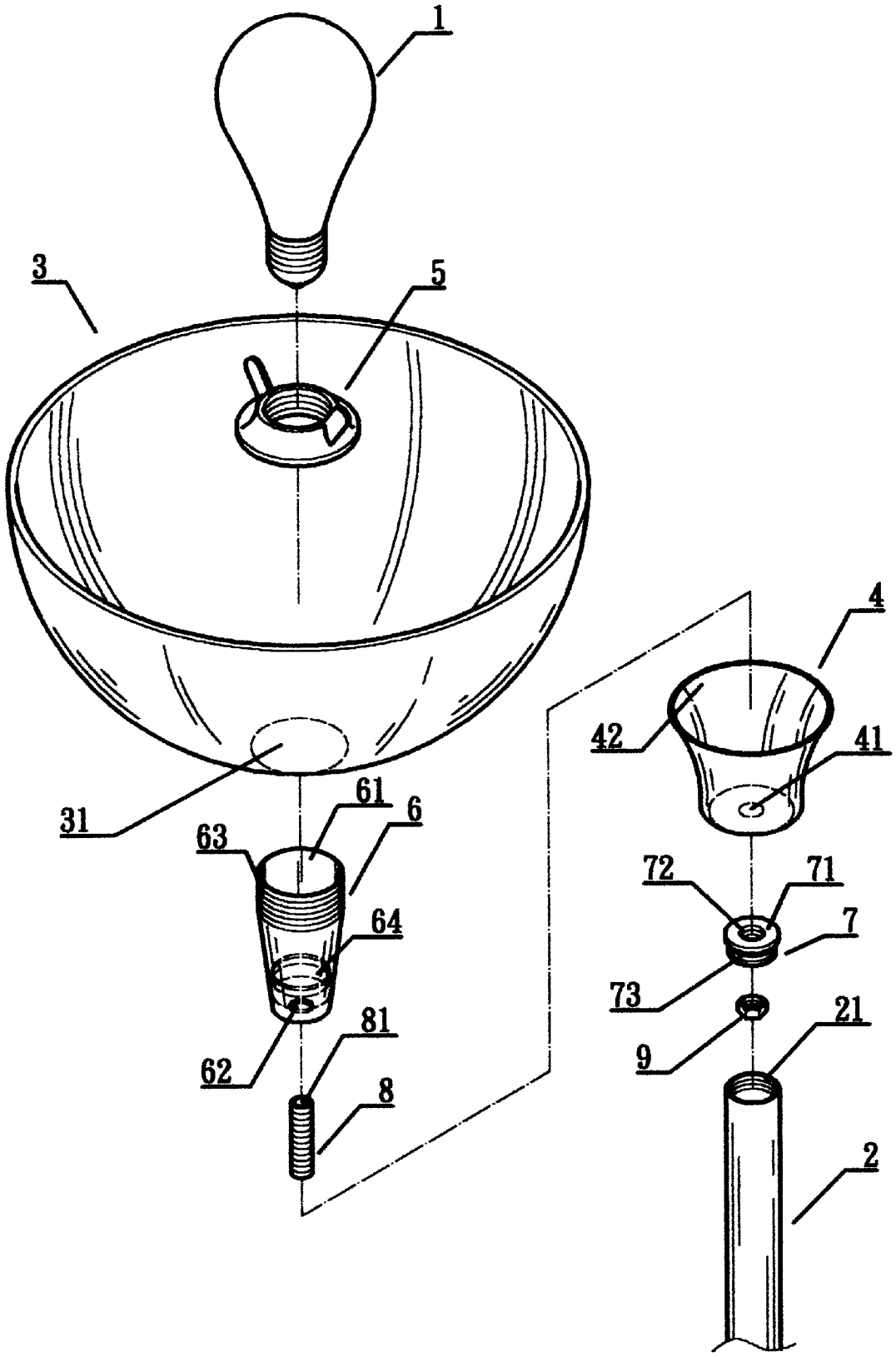
FIG. 1 is a perspective exploded view of the present invention.
Figure 2:
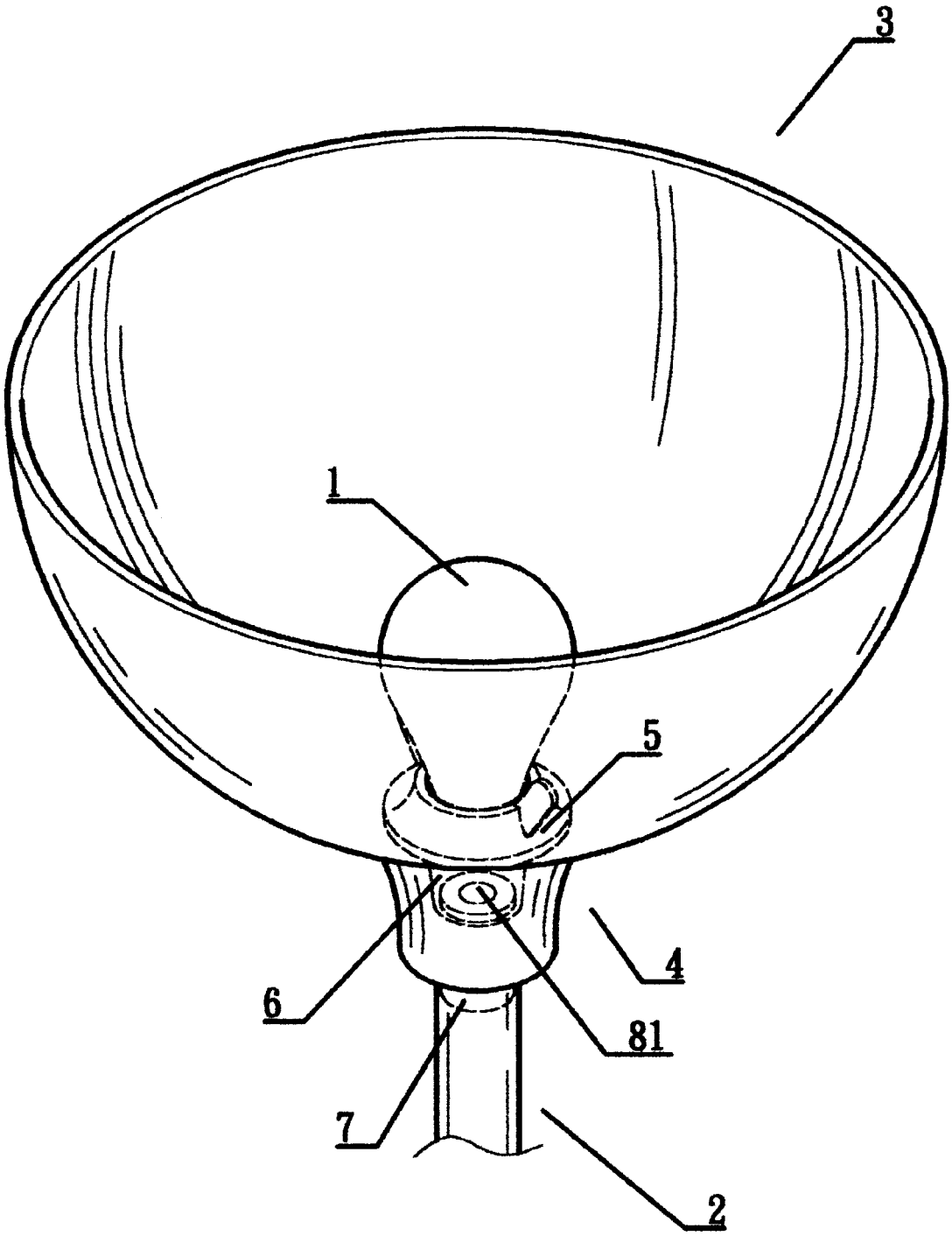
FIG. 2 is an assembled view of the present invention in use.

With reference to FIGS. 1 and 2, the present invention comprises a light bulb 1, a lamp pole 2, a lampshade 3, a lamp cup 4, a butterfly-shaped nut 5, a light bulb holder 6, an end cover 7, a hollow bolt 8, and a securing nut 9. An upper side of the lamp pole 2 is provided with internal threads 21. The lampshade 3 is centrally provided with a through hole 31. The lamp cup 4 is provided with a through hole 41 at the center of its bottom portion, and a flared portion 42 at an upper side to support the bottom portion of the lampshade 3. The end cover 7 is formed with a stop edge 71 on an upper side thereof, and is provided with a central threaded hole 72. A small-diameter portion below the stop edge 71 is provided with an external threaded section 73. The hollow bolt 8 is centrally provided with a power source wire protective through hole 81. The light bulb holder 6 is configured to be a recess 61 having a threaded hole 62 at the center of its bottom portion, and a section of external threads 63 on an upper side, with a light bulb locking seat 64 extending upwardly from the bottom portion.

During assembly, a power source wire (not shown) is connected to the light bulb locking seat 64 and led out through the protective through hole 81 of the hollow bolt 8. The upper section of the hollow bolt 8 engages the threaded hole 62 from the lower side of the light bulb holder 6. The lower section of the hollow bolt 8 then enters the flared portion 42 on the upper side of the lamp cup 4 and goes out through the through hole 41 to lock with the central threaded hole 72 of the end cover 7. The securing nut 9 is then used to lock tightly with the remaining exposed portion of the hollow bolt 8. When the power source wire (not shown) is extended into a hollow interior of the lamp pole 2, the external threaded section 73 on the lower side of the end cover 7 will engage lockably with the internal threads 21 of the lamp pole 2. Finally, the light bulb holder 6 enters from the through hole 31 on the lower side of the lampshade 3, and the butterfly-shaped nut 5 is locked tightly with the external threads 63 on the upper side of the light bulb holder 6 to cause the lower bottom portion of the lampshade 3 and the flared portion 42 on the upper side of the lamp cup 4 to be in tight and close fit for supporting and positioning purposes. By means of the above-described arrangement, the light bulb 1 can be locked directly into the light bulb locking seat 64 in the light bulb seat 6 at the bottom portion. And due to the arrangement of the recess 61, the light bulb 1 can be locked deeper into the light bulb holder 6, without projecting excessively from the lampshade 3. Furthermore, connection of the power source wire is convenient and easy, and the overall assembly is more pleasing and safe.

In summary, by means of the present invention, the light bulb of the lamp assembly will not project excessively from the lampshade, so that the overall assembly appears elegant and graceful, and is safe to use. Besides, it is a do-it-yourself assembly that can be assembled with facile.

Although the present invention has been illustrated and described with reference to the preferred embodiment thereof, it should be understood that it is in no way limited to the details of such embodiment but is capable of numerous modifications within the scope of the appended claims.

What is claimed is:

1. A lamp assembly, comprising a light bulb, a lamp pole, a lampshade, a lamp cup, a butterfly-shaped nut, a light bulb holder, an end cover, a hollow bolt, and a securing nut, wherein said lamp pole is provided with an internal threaded section on an upper side thereof;

said lampshade is centrally provided with a through hole;

said lamp cup is provided with a through hole in the center of a bottom portion thereof, and a flared portion on an upper side thereof for supporting a bottom portion of said lampshade;

said end cover is formed with a stop edge on an upper side thereof, a central threaded hole, and a small-diameter portion with external threads below said stop edge;

said hollow bolt is centrally provided with a power source wire protective through hole; and said light bulb holder is formed with a recess and is provided with a threaded hole in the center of a bottom portion thereof, said light bulb holder further having an external threaded section on an upper side, and a light bulb locking seat extending upwardly from the bottom portion, whereby in assembly, an upper section of said hollow bolt enters the upper side of said light bulb holder to lock with said threaded hole, with a lower portion thereof inserted into said flared portion on the upper side of said lamp cup and out through said through hole of said lamp cup to lock with said central threaded hole of said end cover, said securing nut being utilized to lock with the remaining portion of said hollow bolt, said external threaded section on the lower side of said end cover being locked screwably with said internal threaded section of said lamp pole, said light bulb holder entering via said through hole on the lower side of said lampshade, said butterfly-shaped nut being utilized to lock tightly with said external threaded section on the upper side of said light bulb holder to cause a bottom portion of said lampshade and said flared portion of said lamp cup to be in tight fit for supporting and positioning purposes, whereby said light bulb can directly lock into said light bulb locking seat in said light bulb seat at the bottom and go relatively deep into said light bulb holder.

* * * * *